US008109816B1

(12) United States Patent
Grober

(10) Patent No.: US 8,109,816 B1
(45) Date of Patent: Feb. 7, 2012

(54) METHOD AND APPARATUS FOR MEASUREMENT AND ANALYSIS OF A GOLF SWING

(75) Inventor: Robert D Grober, Milford, CT (US)

(73) Assignee: Yale University, New Haven, CT (US)

( * ) Notice: Subject to any disclaimer, the term of this patent is extended or adjusted under 35 U.S.C. 154(b) by 831 days.

(21) Appl. No.: 11/809,120

(22) Filed: May 31, 2007

(51) Int. Cl.
*A63F 9/24* (2006.01)

(52) U.S. Cl. ..... 463/3; 473/223

(58) Field of Classification Search ..... 463/3; 473/223
See application file for complete search history.

(56) References Cited

U.S. PATENT DOCUMENTS

| | | | | |
|---|---|---|---|---|
| 6,192,323 | B1 * | 2/2001 | Boehm | 702/182 |
| 6,224,493 | B1 | 5/2001 | Lee et al. | |
| 6,385,559 | B2 | 5/2002 | Boehm | |
| 6,402,634 | B2 | 6/2002 | Lee et al. | |
| 6,490,542 | B2 | 12/2002 | Boehm | |
| 6,611,792 | B2 | 8/2003 | Boehm | |
| 6,638,175 | B2 | 10/2003 | Lee et al. | |
| 6,648,769 | B2 | 11/2003 | Lee et al. | |
| 6,658,371 | B2 | 12/2003 | Boehm et al. | |
| 7,041,014 | B2 * | 5/2006 | Wright et al. | 473/409 |
| 7,160,200 | B2 | 1/2007 | Grober | |
| 2004/0257342 | A1 * | 12/2004 | Chiu et al. | 345/168 |

OTHER PUBLICATIONS

The Physics of Golf, Theodore P. Jorgensen, pp. 132-147, American Institute of Physics, 1994.

* cited by examiner

*Primary Examiner* — Pierre E Elisca
(74) *Attorney, Agent, or Firm* — Carmody & Torrance LLP

(57) ABSTRACT

A method for analyzing at least one golf swing parameter using a plurality of accelerometers located proximate the distal ends of a golf club, a signal processing and display system utilizing a double pendulum model of a golf club swing, said model for describing swing parameters and having an upper portion, a pivot point and a lower portion, the method comprising the steps of entering initial swing conditions and golf club parameters; performing a swing and collecting data from the accelerometers; determining a differential mode signal from the acceleration data; calculating the pivot point location relative to each accelerometer using the accelerometer data; calculating a common mode signal using the pivot point; and determining at least one golf swing parameter as a function of time using the common mode signal. In a specific embodiment, the step of calculating the pivot point location relative to each accelerometer comprises the step of minimizing the contribution of the common mode signal into an accelerometer signal comprising the differential mode signal and the common mode signal. The method may also comprise the step of displaying the at least one golf swing parameter.

18 Claims, 8 Drawing Sheets

METHOD AND APPARATUS FOR MEASUREMENT AND ANALYSIS OF A GOLF SWING

BACKGROUND OF THE INVENTION

This invention relates to a system and method for measuring and analyzing acceleration data from a golf club and for applying said data to golf swing analysis.

The use of electronics in the shaft or club head of a golf club to measure golf swing characteristics has been the subject of considerable past work. Modern implementations offer a large number of sensors and computational power all concealed within the shaft. Over time, the tendency has been to make ever more sophisticated measurements in an effort to obtain increasingly detailed understanding of the golf swing.

U.S. Pat. Nos. 6,648,769, 6,638,175, 6,402,634 and 6,224,493 describe instrumented golf clubs that use accelerometers and strain gages mounted in the club head and an angular rate sensor to measure the angular speed of the grip area of the club.

U.S. Pat. Nos. 6,658,371, 6,611,792, 6,490,542, 6,385,559 and 6,192,323 describe methods for matching golfers with a driver and ball by measuring a golfer's club head speed and comparing that measured data with recorded sets of data that correlate a few key variables that can aid in matching golfers with the most suitable club and ball.

However, as will be seen below, further advances in the state of the art are desirable and believed to be achieved by the present invention.

OBJECTIVES AND SUMMARY OF THE INVENTION

It is thus an objective of the present invention to improve the state of the art.

It is another objective to provide improved measurement and analyses methodologies for a golf swing.

Another objective of the present invention is the calculation, identification and display of key parameters of the golf swing using a double pendulum model of the golf swing so that they can be used to improve a golfer's performance.

Other objectives and advantages of the present invention will be described below and/or be obvious in view of the disclosure below.

The present invention accordingly comprises the features of construction, combination of elements, arrangement of parts and sequence of steps which will be exemplified in the construction, illustration and description hereinafter set forth, and the scope of the invention will be indicated by the claims.

To that end, in a preferred embodiment, the present invention generally speaking, is directed to a method for analyzing at least one golf swing parameter using a plurality of accelerometers located at distal ends of a golf club, a signal processing and display system utilizing a double pendulum model of a golf club swing, said model for describing swing parameters and having an upper portion, a pivot and a lower portion, the method comprising the steps of entering initial swing conditions and golf club parameters; performing a swing and collecting data from the accelerometers; determining a differential mode signal from the acceleration data; calculating the pivot point location relative to each accelerometer using the accelerometer data; calculating a common mode signal using the pivot point and acceleration data; and determining at least one golf swing parameter as a function of time using the common mode signal.

In another embodiment, the present invention is directed to a method for analyzing at least one golf swing parameter using (i) an instrumented golf club having two accelerometers located at respective distal ends of a golf club, (ii) data collection means and (iii) computer analysis means running a program based on a double pendulum model of a golf club swing, the method comprising the steps of entering initial swing conditions and golf club parameters; performing a swing and collecting data from the accelerometers; determining a differential mode signal from the acceleration data; calculating the pivot point location relative to each accelerometer using the accelerometer data; calculating a common mode signal using the pivot point and acceleration data; and determining at least one golf swing parameter as a function of time using the common mode signal.

In yet another preferred embodiment, a method for analyzing at least one motion parameter of an elongated member moving relative to a pivot point using a plurality of accelerometers located at proximate distal ends of the elongated member, a signal processing and display system utilizing a model relating the motion of the pivot point and accelerometers to a reference point is provided, the method comprising the steps of entering initial positional and physical parameters of the elongated member; moving the elongated member about the pivot point and collecting data from the accelerometers; determining a differential mode signal from the acceleration data; calculating the pivot point location relative to each accelerometer using the accelerometer data; calculating a common mode signal using the pivot point location relative to each accelerometer; and determining at least one parameter of motion for the elongated member as a function of time using the common mode signal.

And, in yet another preferred embodiment, a method is provided for analyzing at least one motion parameter of a swinging elongated member using a plurality of accelerometers located at proximate distal ends of the elongated member, a signal processing and display system utilizing a double pendulum model of the swinging elongated member, said model having an upper portion, a pivot point and a lower portion, the method comprising the steps of entering initial positional and physical conditions of the elongated member; swinging the elongated member and collecting data from the accelerometers; determining a differential mode signal from the acceleration data; calculating the pivot point location relative to each accelerometer using the accelerometer data; calculating a common mode signal using the pivot point location relative to each accelerometer; and determining at least one motion parameter of the elongated member as a function of time using the common mode signal.

In a specific embodiment, the measurement system preferably comprises two accelerometers mounted in the shaft of a golf club with the direction of maximum sensitivity oriented along the axis of the shaft. One accelerometer is located under the grip, preferably near where the hands would be located. The other is located further down the shaft nearer to the club head.

The two accelerometers yield a common mode signal and a differential mode signal. The common mode signal contains components that are present in both accelerometers while the differential mode signal is the difference between the accelerometer values and is proportional to the rotational kinetic energy of the golf club. An important objective of the present invention is the automatic location of a pivot point of the double pendulum to substantially eliminate mixing of common mode accelerometer signals with differential mode accelerometer signals and therefore provide improved analysis of golf swing parameters that include common mode signal components.

BRIEF DESCRIPTION OF THE DRAWINGS

For a fuller understanding of the invention, reference is made to the following description taken in connection with the accompanying figures, in which.

While all features may not be labeled in each Figure, all elements with like reference numerals refer to similar or identical parts.

DETAILED DESCRIPTION OF THE PREFERRED EMBODIMENTS

The entire contents of U.S. Patent Application 2006/0063600, also by Robert Grober, is hereby incorporated into this application by reference as if set forth in its entirety.

Figure 1:
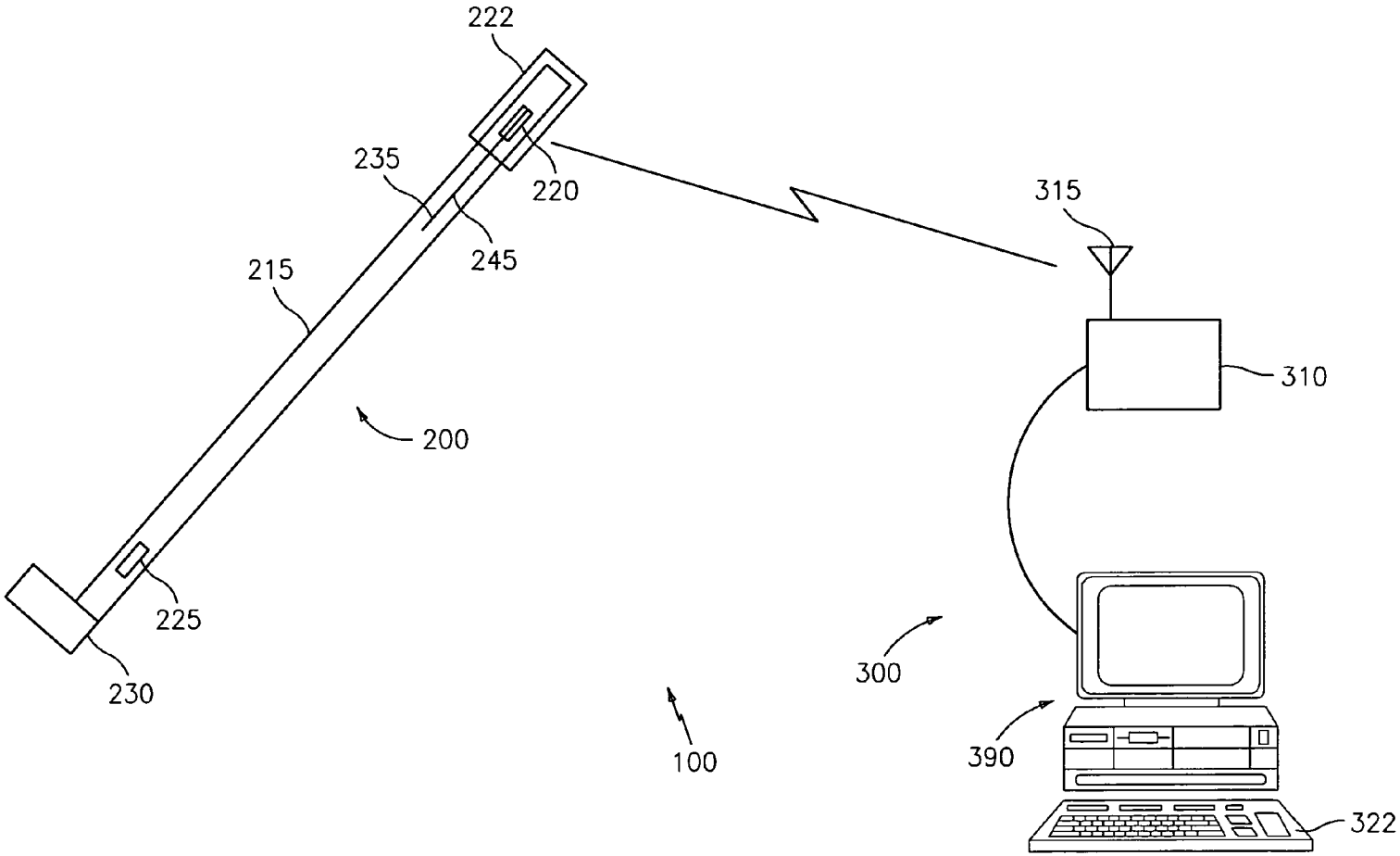
FIG. 1 is an illustration of a golf swing analysis system constructed in accordance with the present invention.
Figure 2:
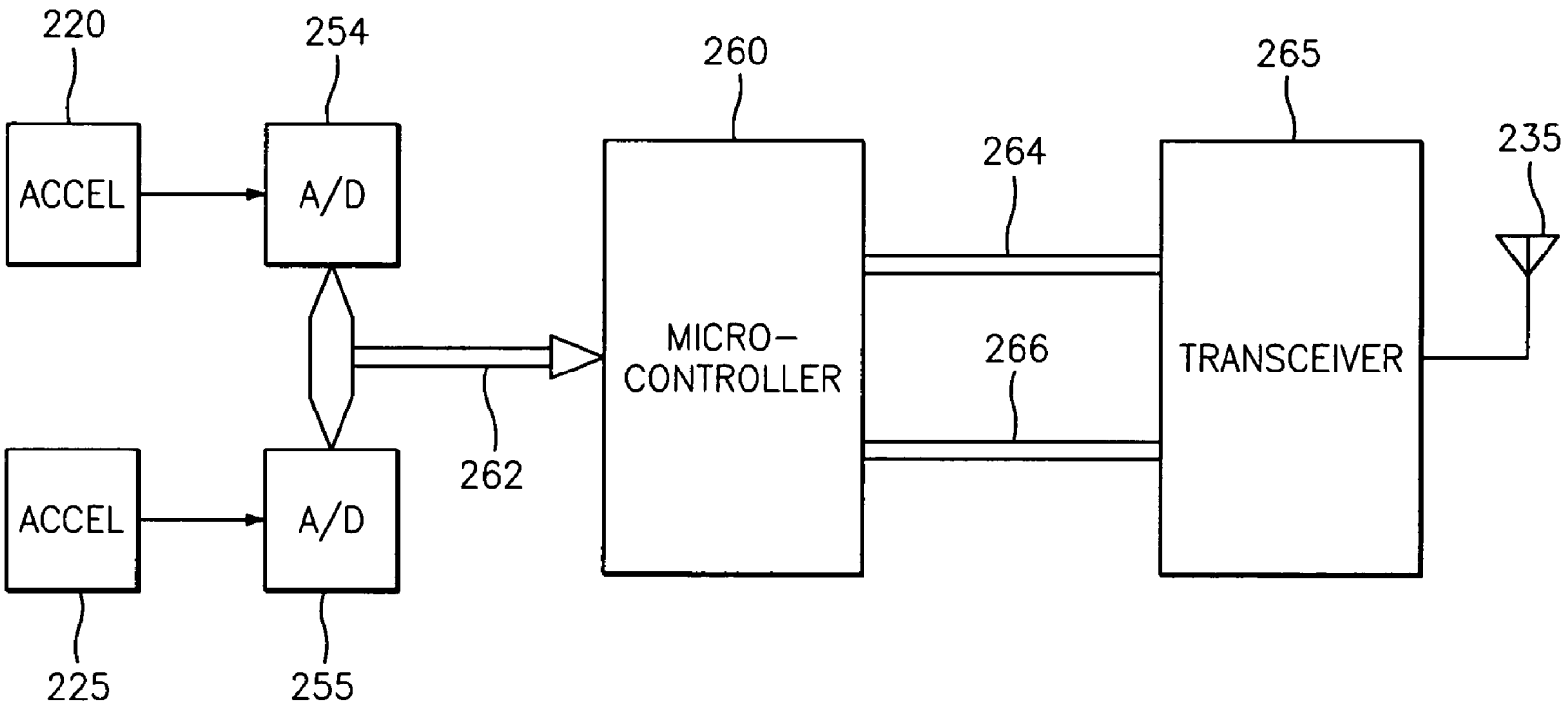
FIG. 2 is a block diagram of the electronics located in a golf club of a preferred embodiment of the present invention.

Reference is first made to FIGS. 1 and 2 wherein a measurement and display system constructed in accordance with the present invention is generally shown at 100. A golf club constructed in accordance with the present invention is indicated generally at 200 and a wireless interface 310 and associated signal processing and display system 390 are generally shown at 300. Wireless interface 310 provides a wireless link between club 200 and signal processing and display system 390.

The golf club at 200 comprises an elongated member, generally indicated at 215, which itself comprises at least a shaft 215 and a club head 230. Golf club 200 also comprises a first accelerometer 220 generally located near club grip 222 and a second accelerometer 225 located closer to club head 230. Both accelerometers are preferably coupled to member 215. In the preferred embodiment accelerometer 220 is an Analog Devices ADXL 78 and accelerometer 225 is an Analog Devices ADXL 193. The foregoing positions more than satisfy the understanding that the accelerometers are located proximate the distal ends of the shaft.

Accelerometers 220 and 225 monitor accelerations along the axis of member 215 as a golfer (not shown) swings club 200. Preferably located in member 215 is additional circuitry, generally indicated at 245, comprising two (2) A/D converters 254 and 255 respectively operatively coupled to accelerometers 220 and 225, a microprocessor 260 coupled to converters 254, 255 and a wireless transceiver 265 coupled between the output of microcontroller 260 and antenna 235.

As shown in FIG. 2, the analog outputs of the accelerometers are fed to A/D converters 254 and 255 where they are converted into digital data streams and fed via serial link 262 to microprocessor 260 for processing. The preferred embodiment includes Microchip MCP3201 12 bit A/D converters to convert the analog output of accelerometers 220 and 225 into digital data streams that are fed to microprocessor 260, which preferably is a Microchip 8 bit microcontroller, the PIC 16F873A.

Figure 3:
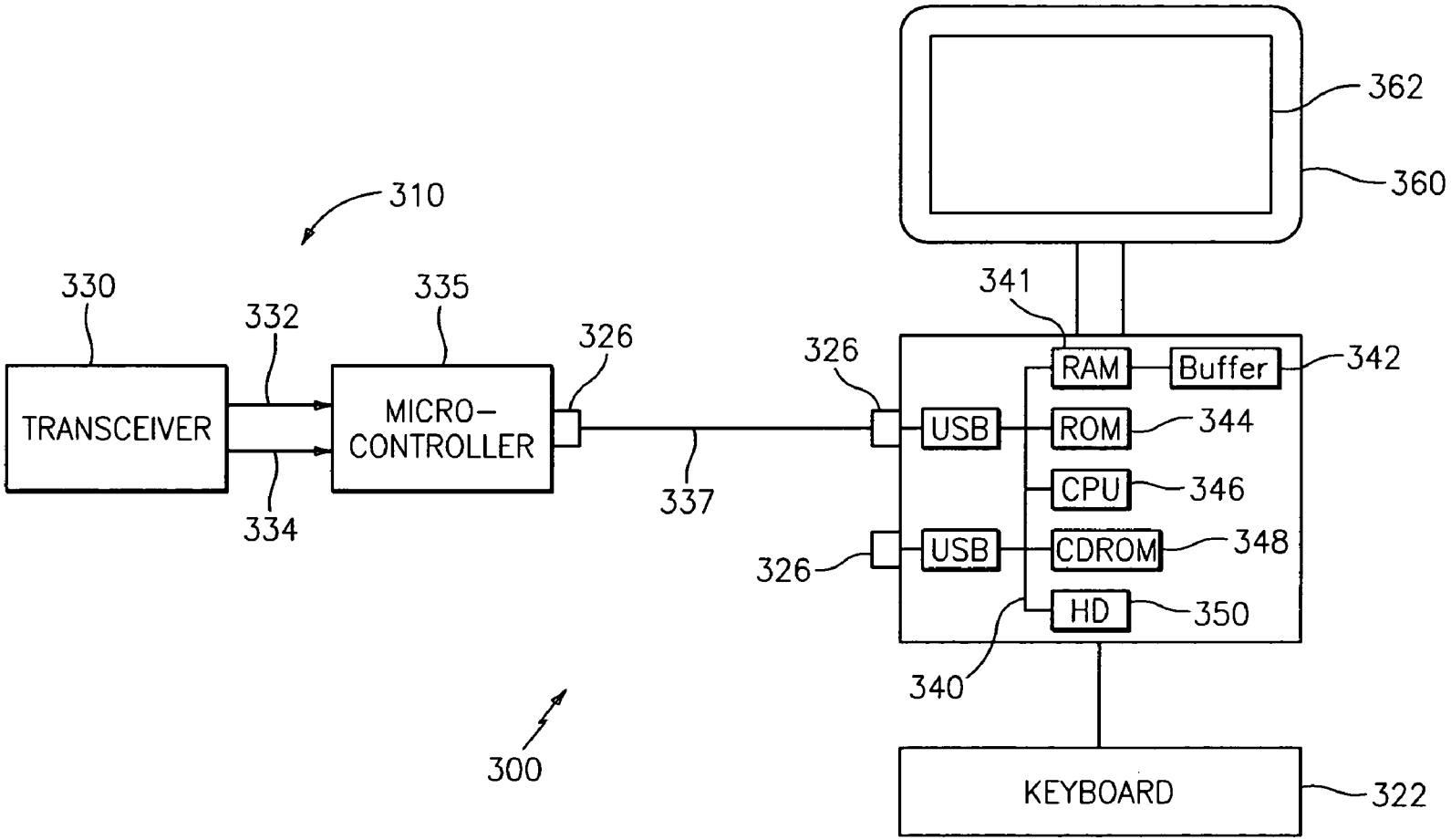
FIG. 3 is a block diagram of a wireless interface and circuits of a signal processor and display system.

Microprocessor 260 supervises the collection of data from the A/D converters 254 and 255 and formats the resulting 12 bit NRZ data for transmission to signal processing and display system 390 via transceiver 265, antenna 235 and wireless interface 310 (shown in FIG. 3). In alternate embodiments collected data can be stored on a memory card or thumb drive and removed/disconnected from club 200 and inserted into signal processing and display system 390 for processing.

Transceiver 265 is preferably a Chipcon CC1000 configured to receive the NRZ serial data from microprocessor 260, reformat the data into synchronous Manchester coding and preferably feed antenna 235 at 915 MHZ. Transceiver initialization values, which include data formatting, frequency selection, etc. are stored in flash memory in microprocessor 260 and fed to transceiver 265 by serial link 266. The initialization data may also originate in signal processing and display system 390 and fed to transceiver 235 via interface 310. The acceleration data stream from microcontroller 260 is sent to transceiver 265 by serial link 264.

As shown in FIG. 3, wireless interface 310 receives the transmitted data via antenna 315 and, in a wired manner known to those skilled in the art, provides the data to signal processing and display system 390. Signal processing and display system 390 preferably comprises a Windows XP based laptop wherein a software program based on the flowchart of FIG. 8 and described herein is executed. This program is preferably programmed in the C/C++ programming language or assembly language where execution speed is important. Signal processing and display system 390 is suitably equipped with keyboard 322, display 360 having a display area 362, and one or more USB ports 326 (with connector and interface circuits) for receiving and sending data to/from wireless interface 310 and receiving external or thumb drives (not shown). In an alternate embodiment signal processing and display system 390 and golf club 200 are equipped with a compatible wireless interface so that wireless interface 310 and transceiver 235 are not needed as a separate unit.

FIG. 3 is a block diagram showing transceiver 330 and microcontroller 335 of wireless interface 310 and signal processing and display system 390 which is generally shown at 300. The 12 bit data transmitted by transceiver 265 and antenna 235 is received by antenna 315 and demodulated back to NRZ code by transceiver 330 and fed to microcontroller 335 via a NRZ serial stream. Serial busses 332 and 334 provide communications between transceiver 330 and microcontroller 335 which is preferably a PIC 18F4550. Microcontroller 335 with associated USP port 326 communicates with signal processing and display system 390 via USB cable 337 and another USB port 326 in communication with bus 340. Internal data buss 340 communicates with ring buffer 342, which is itself part of RAM 341, ROM 344, a CPU 346, CD drive 348, Hard Drive 350 and display 360. In an alternate embodiment microcontroller 335 communicates with signal processing and display system 390 using a conventional serial port.

Accelerometer Measurements

Figure 4A:
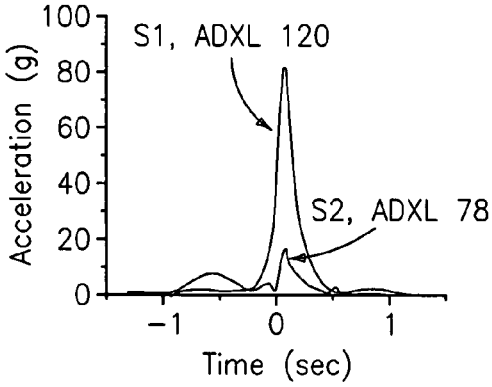
FIGS. 4*a* and 4*b* show raw data for the two accelerometers $S_1$ and $S_2$.
Figure 4B:
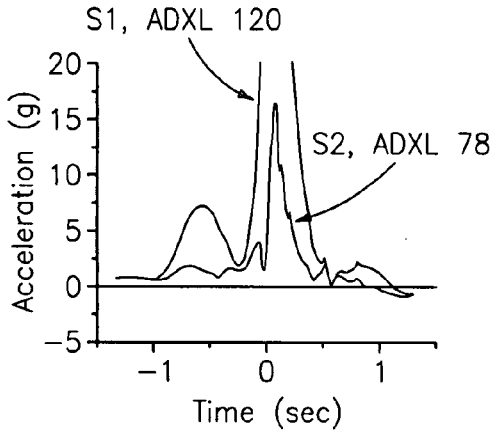

Shown in FIG. 4 is raw data from accelerometer 225 (labeled $S_1$) and from accelerometer 220 (labeled $S_2$) during a single golf swing. The data is transmitted from club 200 and received by wireless interface 310 and fed to signal processing and display system 390 as described above. $S_1$ is from 120 g accelerometer 225 located near the club head 230 end of shaft 215. $S_2$ is from 50 g accelerometer 220 located under grip 222 of club 200. The data used to generate FIGS. 4(*a*) and 4(*b*) are identical, with (b) being scaled so that the details at small accelerations are more visible.

In a preferred embodiment of the invention the zero of the time axis in FIG. 4 can be somewhat arbitrary and roughly corresponds to the point where the club head 230 passes a tee (not shown) holding a golf ball 230 (also not shown). The data in FIG. 4 was taken while swinging a club but not hitting a ball. This was done to prevent the data from being corrupted by the shock of impact. In alternative embodiments an inductive sensor or optical sensor or the like can be used to establish a substantially exact position at which impact would occur without concern for transients disturbing accelerometer data. Alternatively, and as discussed below, a lightweight plastic ball may be used to provide more realism and in this case an acoustic sensor is used to sense impact without affecting accelerometer data.

The data of FIG. 4 consist of 600 pairs of points, each pair taken at 4.42 msec intervals. The data has been normalized such that the y-axis is calibrated in units of gravitational acceleration, 9.8 $m/s^2$.

Figure 8:
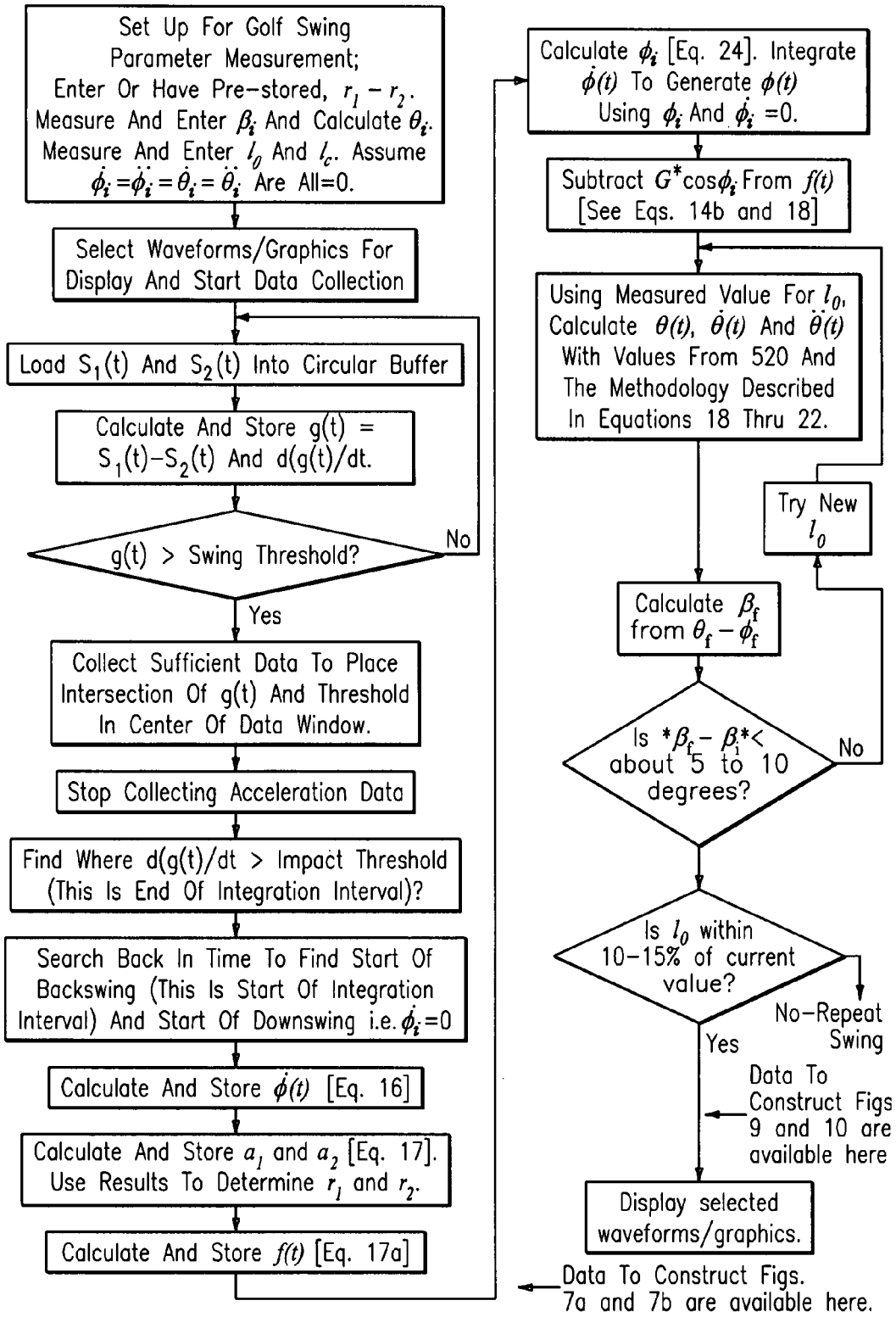
FIG. 8 shows a preferred flow chart for the present invention.

Data similar to that used to generate in FIG. 4 are reduced and processed in accordance with the flow chart of FIG. 8 which shows the program flow used to implement the analysis disclosed in the paragraphs that follow.

Rotational Analysis of a Golf Club

Figure 5:
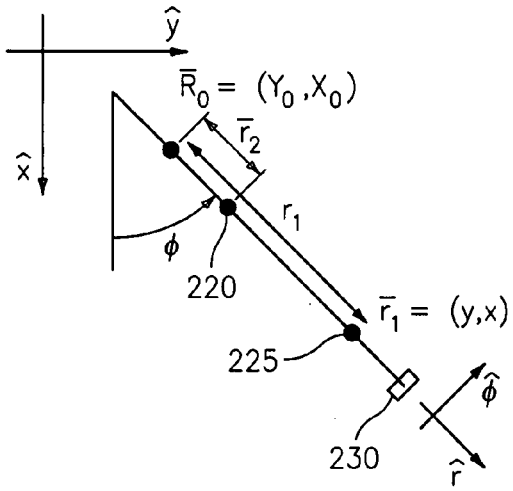
FIG. 5 gives the geometry of the motion of a rigid rod in a fixed plane.

The generalized two-dimensional geometry and motion associated with a point on a golf club in a plane is shown in FIG. 5. All points and motions are referenced to a fixed, inertial, Cartesian coordinate system in the plane of the golf swing with the $\hat{x}$-axis aligned along the direction of gravitational acceleration. Likewise all calculations and notations related to time dependent parameters are shown using continuous time notation. One skilled in the art would recognize however that the invention uses sampled data so that calculations would preferably be accomplished in the digital domain.

The position of the club in space is defined by the coordinates $\vec{R}_0=(Y_0,X_0)$ of the reference point $\vec{R}_0$ on the club and the angle $\phi$ of the club with respect to the $\hat{x}$-axis. The preferred choice for the point $\vec{R}_0$ is that point about which the club rotates. The distance to the general point $\vec{r}_1$ on the shaft is measured relative to the reference point $\vec{R}_0$. The coordinates of $\vec{r}_1$ are given as $$\vec{r}_1=(X_0+\vec{r}_1\cos\phi)\hat{x}+(Y_0+r_1\sin\phi)\hat{y} \tag{1}$$

One determines the generalized acceleration of the point $\vec{r}_1$ as $$\ddot{\vec{r}}_1=(\ddot{X}_0-r_1\dot{\phi}^2\cos\phi-r_1\ddot{\phi}\sin\phi)\hat{x}+(\ddot{Y}_0-r_1\dot{\phi}^2\sin\phi+r_1\ddot{\phi}\cos\phi)\hat{y} \tag{2}$$

It is useful to rewrite this equation in terms of the in terms of the $\hat{r}-\hat{\phi}$ coordinate system, as indicated in FIG. 5. Using the relations $$\hat{x}=\hat{r}\cos\phi-\hat{\phi}\sin\phi \tag{3a}$$

$$\hat{y}=\hat{r}\sin\phi+\hat{\phi}\cos\phi \tag{3b}$$

one obtains $$\ddot{\vec{r}}_1=(\ddot{X}_0\cos\phi+\ddot{Y}_0\sin\phi-r_1\dot{\phi}^2)\hat{r}+(-\ddot{X}_0\sin\phi+\ddot{Y}_0\cos\phi+r_1\ddot{\phi})\hat{\phi} \tag{4}$$

Accelerometers 225 and 220 are located along shaft 215 at positions $\vec{r}_1$ and $\vec{r}_2$ which are measured relative to $\vec{R}_0$ on shaft 215. Accelerometers 225 and 220 are oriented to be most sensitive to accelerations along the axis of shaft 215 and to yield a positive centripetal acceleration as the golf club 200 is swung. The accelerations measured by accelerometers 225 and 220 along the $\vec{r}$-axis are $S_1$ and $S_2$ respectively and have values of:

$$S_1=-\hat{r}\cdot\ddot{\vec{r}}_1=-\ddot{X}_0\cos\phi-\ddot{Y}_0\sin\phi+r_1\dot{\phi}^2 \tag{5a}$$

$$S_2=-\hat{r}\cdot\ddot{\vec{r}}_2=-\ddot{X}_0\cos\phi-\ddot{Y}_0\sin\phi+r_2\dot{\phi}^2 \tag{5b}$$

Because these measurements are made in the presence of earth's gravitational field, the equations above are preferably adjusted to include this effect, yielding the expressions:

$$S_1=-\vec{r}\cdot\ddot{\vec{r}}_1=-\ddot{X}_0\cos\phi-\ddot{Y}_0\sin\phi+r_1\dot{\phi}^2+G^*\cos\phi \tag{6a}$$

$$S_2=-\vec{r}\cdot\ddot{\vec{r}}_2=-\ddot{X}_0\cos\phi-\ddot{Y}_0\sin\phi+r_2\dot{\phi}^2+G^*\cos\phi \tag{6b}$$

where G* is the effective gravitational acceleration in the plane of the golf swing.

These two signals are preferably written in terms of two signals. The first is a common mode signal (contribution to accelerometer output value that is common to the output of both accelerometers), and that is $f(t)=-\ddot{X}_0\cos\phi-\ddot{Y}_0\sin\phi+G^*\cos\phi$, and the second is a differential mode (the difference between the outputs of both accelerometers) resulting value $g(t)=(r_1-r_2)\dot{\phi}^2$. Rewriting $S_1$ and $S_2$ in a generic form gives:

$$S_1=f(t)+\frac{r_1}{r_1-r_2}g(t);\quad\text{and} \tag{7a}$$

$$S_2=f(t)+\frac{r_2}{r_1-r_2}g(t) \tag{7b}$$

The differential mode signal, g(t), is recovered by taking the difference of the two signals (after appropriate scaling), $S_1-S_2=g(t)=(r_1-r_2)\dot{\phi}^2$. Because the separation between accelerometers 225 and 220, $r_1-r_2$, is easily measured, knowledge of g(t) permits the calculation of $\phi(t)$ as discussed below.

While the differential mode signal is substantially independent of the choice of the point $\vec{R}_0$, the common mode signal depends strongly on the choice of the point $\vec{R}_0$. Thus, the choice of the point $\vec{R}_0$ determines how much of the differential mode signal is mixed into the calculated common mode signal and therefore effects the calculation of $\phi(t)$. This sensitivity to $\vec{R}_0$ makes recovering f(t) more difficult and requires consideration of the motion of point $\vec{R}_0=(Y_0,X_0)$. To this end it has been discovered that the use of a double pendulum model gives good results.

Figure 6:
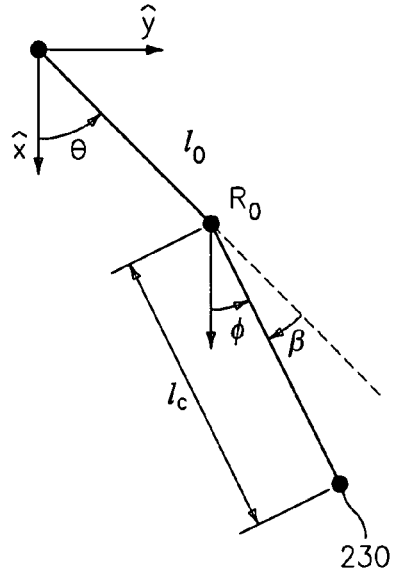
FIG. 6 shows the geometry of a double pendulum model representing a golfer and club.

Use of the double pendulum in an analysis of the golf swing was developed by T. P. Jorgensen. The model he used is shown in FIG. 6 and reasonably represents the golf swing of capable golfers. The angle θ defines the angle of an upper portion of length $l_0$ (the lower termination of the upper portion with length $l_0$ is at the point $\vec{R}_0$) with respect to the x-axis and φ defines the angle of the lower portion (the club 200) of length $l_c$, with respect to the x-axis. The upper portion represents the link between the club and the golfer's body (not shown).

The angle β defines the angle of the lower portion with respect to the upper portion, and is interpreted as the wrist cocking angle. The model assumes no translational motion of the center of the swing which is at the upper point of the upper portion $l_0$. Additionally, the model assumes a rigid shaft for club 200 as it is known that shaft dynamics yield second order effects.

The relevant portion golf club 200 is modeled as a rigid rod having a length $l_c$, that is measured from the point $R_0$ to approximately the center of club head 230. The orientation of golf club 200 is preferably measured by the angle β=θ−φ, which, as previously noted, roughly corresponds to the angle through which the wrists are cocked.

The accelerometers 225 and 220 are oriented along the axis of the golf club 200 with their positions along the club also measured from the hinged point $R_0$ between the upper and lower portions of the pendulum and given by lengths $r_1$ and $r_2$ (see FIG. 5). Following the analysis above, their position in space are given as:

$$\vec{r}_1=(l_0\cos\theta+r_1\cos\phi)\hat{x}+(l_0\sin\theta+r_1\sin\phi)\hat{y} \tag{8a}$$

$$\vec{r}_2=(l_0\cos\theta+r_2\cos\phi)\hat{x}+(l_0\sin\theta+r_2\sin\phi)\hat{y} \tag{8b}$$

One can determine the generalized acceleration of the two points $\vec{r}_1$ and $\vec{r}_2$ as:

$$\ddot{\vec{r}}_1=-\left(l_0\dot{\theta}^2\cos\theta+l_0\ddot{\theta}\sin\theta+r_1\dot{\phi}^2\cos\phi+r_1\ddot{\phi}\sin\phi\right)\hat{x}-\left(l_0\dot{\theta}^2\sin\theta-l_0\ddot{\theta}\cos\theta+r_1\dot{\phi}^2\sin\phi-r_1\ddot{\phi}\cos\phi\right)\hat{y} \tag{9a}$$

$$\ddot{\vec{r}}_2=-\left(l_0\dot{\theta}^2\cos\theta+l_0\ddot{\theta}\sin\theta+r_2\dot{\phi}^2\cos\phi+r_2\ddot{\phi}\sin\phi\right)\hat{x}-\left(l_0\dot{\theta}^2\sin\theta-l_0\ddot{\theta}\cos\theta+r_2\dot{\phi}^2\sin\phi-r_2\ddot{\phi}\cos\phi\right)\hat{y} \tag{9b}$$

It is useful to rewrite the above the equations in terms of the r−φ coordinate system attached to the golf club with the r-axis aligned along the shaft. Using the relations:

$$\hat{x}=\hat{r}\cos\phi-\hat{\phi}\sin\phi \tag{10a}$$

$$\hat{y}=\hat{r}\sin\phi+\hat{\phi}\cos\phi \tag{10b}$$

and the trigonometric identities $$\sin\theta\cos\phi-\cos\theta\sin\phi=\sin(\theta-\phi) \tag{11a}$$

$$\sin\theta\sin\phi+\cos\theta\cos\phi=\cos(\theta-\phi) \tag{11b}$$

one obtains $$\ddot{\vec{r}}_1=-(r_1\dot{\phi}^2+l_0\dot{\theta}^2\cos\beta+l_0\ddot{\theta}\sin\beta)\hat{r}+(r_1\ddot{\phi}-l_0\dot{\theta}^2\sin\beta+l_0\ddot{\theta}\cos\beta)\hat{\phi} \tag{12a}$$

$$\ddot{\vec{r}}_2=-(r_1\dot{\phi}^2+l_0\dot{\theta}^2\cos\beta+l_0\ddot{\theta}\sin\beta)\hat{r}+(r_2\ddot{\phi}-l_0\dot{\theta}^2\sin\beta+l_0\ddot{\theta}\cos\beta)\hat{\phi} \tag{12b}$$

Projecting the acceleration along the negative $\hat{r}$-axis yields a positive centripetal acceleration:

$$S_1=-\hat{r}\cdot\ddot{\vec{r}}_1=r_1\dot{\phi}^2+l_0\dot{\theta}^2\cos\beta+l_0\ddot{\theta}\sin\beta+G^*\cos\phi \tag{13a}$$

$$S_2=-\hat{r}\cdot\ddot{\vec{r}}_2=r_2\dot{\phi}^2+l_0\dot{\theta}^2\cos\beta+l_0\ddot{\theta}\sin\beta+G^*\cos\phi \tag{13b}$$

that includes the gravitational force G* which is the projection of the gravitational acceleration into the plane of motion along the axis of the club 200.

The differential mode and common mode signals are given as $$g(t)=(r_1-r_2)\dot{\phi}^2;\text{ and} \tag{14a}$$

$$f(t)=l_0(\dot{\theta}^2\cos\beta+\ddot{\theta}\sin\beta)+G^*\cos\phi \tag{14b}$$

where the generic terms $\ddot{X}_0$ and $\ddot{Y}_0$ are replaced with explicit expressions in terms of the motion of the double pendulum. The two signals can therefore be written as, $$S_1=f(t)+\frac{r_1}{r_1-r_2}g(t) \tag{15a}$$

$$S_2=f(t)+\frac{r_2}{r_1-r_2}g(t) \tag{15b}$$

Determination of a Calculation Time Window

Impact with Actual Golf Ball

In a preferred embodiment, the calculation time window is determined by examining the contents of ring buffer 342 which holds approximately 5 seconds of data. Signal processing and display system 390 receives data from interface 310 and continuously loads the circular buffer 342 with the data from club 200. The signal processing and display system 390 continuously calculate the difference signal, g(t). When g(t) becomes larger than a preset threshold, typically 300-500 $m/s^2$, the system acknowledges that a swing is occurring by generating a trigger. This magnitude of signal only happens during the downswing in the vicinity of the ball. Buffer 342 continues to store data for about 2.5 seconds so that the trigger point can be substantially centered in buffer 342 with approximately 2.5 seconds of data on either side of the trigger point. The contents of the buffer then includes a complete data set for analysis of the golf swing.

The actual time of impact is preferably determined by calculating the derivative of the difference signal, g(t), and comparing this value to a reference level (impact threshold) of order of −5 g/sampling period (i.e. −5 g/4.42 msec), which is large in magnitude and negative in sign. When the derivative of g(t) is more negative than this reference level at a point in time after the trigger threshold, an impact has occurred.

When a real ball is hit the transfer of momentum from club head 230 to the ball causes a sharp discontinuity in g(t) and therefore a spike in the derivative in g(t). The point of impact (378 in FIG. 11) defines the end of the integration interval for the calculations described herein. The start of the swing is determined as described in the following paragraph.

The beginning of the backswing swing and the transition from backswing to downswing is preferably determined by having the signal processing and display system 390 search through buffer 342, working backward in time from the point of impact looking for two points at which $\dot{\phi}_i$, (from Eq. 16 below) equals 0; the first point (376 in FIG. 11) being where the backswing transitions to a downswing and the second point being the beginning of the backswing 374 in FIG. 11. The point at which the swing begins, i.e. the beginning of the backswing, is taken as the origin of time, t=0.

Impact with Simulated Ball

In an alternate embodiment a simulated ball, one of plastic for example, is used to further improve the practice process. As would be known to one skilled in the art, the plastic ball being of very low mass would not substantially affect readings from accelerometers 220 and 225 and or a change in club head 230's momentum at impact. The impact does however generate an acoustic spike and this spike is sense by a microphone near the ball and fed directly to signal processing and display 390 to initiate an interrupt. This interrupt inserts a marker into the data stream received from interface 310. An advantage of this latter approach is that if desired, positional data can be developed into the follow through of the swing. The start of the swing is determined as before by having signal processing and display system 390 search backwards through the buffer 342 from the point of "impact" looking for a second data point at which $\dot{\phi}_i$, (from Eq. 16 below) yields 0; the first point being where a backswing transitions to a downswing.

Determination of Club Positional Information

An object of the present invention is to use the values of $S_1$ and $S_2$ to determine $\theta(t)$ and $\phi(t)$ and therefore the position and timing associated with a swing of golf club 200.

External means are preferably used to determine the initial values $\phi(0)=\phi_i$, $\theta(0)=\theta_i$, from which one calculates $\beta_i=\theta_i-\phi_i$. These can be determined through direct measurement, video analysis, or various other techniques known to those skilled in the art. Generically, $\phi_i$ is constrained relatively close to zero, generally between 5 and 20 degrees. $\theta_i$ is likewise comparably constrained. It is assumed that the initial values of $\dot{\phi}_i=\ddot{\phi}_i=\dot{\theta}_i=\ddot{\theta}_i$ are all =0.

Since $S_1-S_2=g(t)$, using equation (14a) we find that:

$$\dot{\phi} = \pm\sqrt{\frac{S_1 - S_2}{r_1 - r_2}}. \tag{16}$$

where the separation between accelerometers, $r_1-r_2$ is know at time of manufacture; and the sign convention is negative in the backswing and positive in the downswing. Using the initial conditions described above, $\dot{\phi}(t)$ is integrated to yield $\phi(t)$ It has been determined that providing an accurate determination of f(t) from the expressions for $S_1$ and $S_2$ given in equations 13a and 13b is non-trivial in a practice or playing environment because it is not readily apparent around which point, $R_0$ the club rotates. Since $r_1$ and $r_2$ are measured relative to this point of rotation, the point must be known with reasonable accuracy if the resulting calculation of f(t) is to be useful in a calculation of $\theta(t)$ and $\phi(t)$.

It is reasonable to assume that this point $R_0$ is between the hands, but exactly where the golfer grips the club can vary from shot to shot and locating this point somewhere within the hands can introduce errors on the order 10-15% due to the spatial extent of the grip. This problem is solved by the present invention by using the hardware described above and software based on the development below.

As shown above, S(t) is of the form $S(t)=f(t)+\alpha g(t)$ and g(t) is obtained by taking the difference $S_1-S_2$. However we do not know either $\alpha$ or f(t). The preferred embodiment for determining $\alpha$ is to minimize the quantity $\int[S(t)-\alpha g(t)]^2dt$. Taking a derivative with respect to $\alpha$ and rearranging yields the expression:

$$a = \frac{\int S(t)g(t)dt}{\int g(t)^2 dt}. \tag{17}$$

where the integrations are performed over the time interval discussed above.

Using this expression for $\alpha$, $f(t)=S(t)-\alpha g(t)$ (Eq. 17a) is determined. This is done for $S_1$ and $S_2$. The resulting values of $\alpha$ are then used to calculate $r_1$ and $r_2$.

Figure 7A:
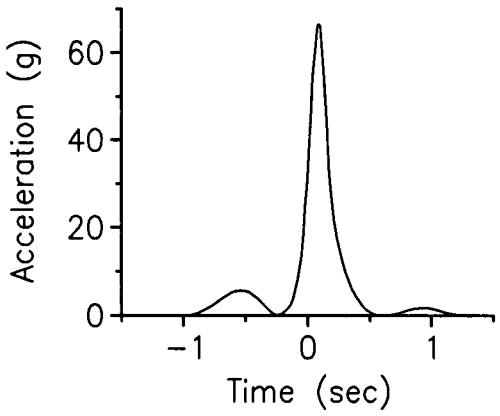
FIGS. 7*a* and 7*b* show a differential mode signal g(t) and common mode signal f(t) calculated from the data displayed in FIGS. 4*a* and 4*b;*
Figure 7B:
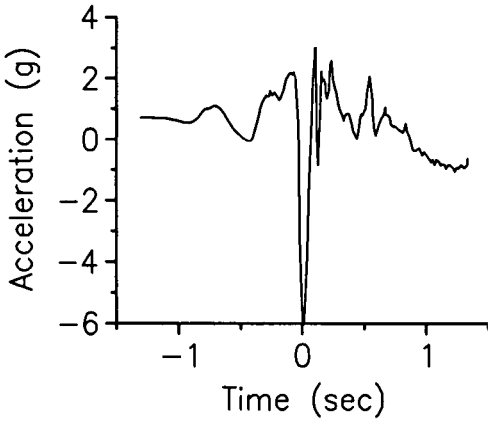

FIGS. 7(*a*) and 7(*b*) display the result of this calculation using the same data set used to generate FIG. 4. The data in FIG. 7(*a*) is the result for g(t) and the data in FIG. 7(*b*) is the result for f(t). From g(t) many details about the timing of the swing can be determined, such as the duration of the backswing and downswing. Furthermore, g(t) is intuitively interpreted as the motion of the golf club. While f(t) does not have a simple and intuitive interpretation, the inventor has found that there is substantial information contained in this signal. For example f(t) primarily yields information about the motion of the point about which the club is rotating. In the present invention this is the motion of the hands. Importantly f(t) also shows at 380 and 382 of FIG. 11_the maximum and minimum value of the common mode signal during "release" as well position of "release" events relative to ball impact. The aforementioned golf swing parameters, among others, are important indicators of golf swing quality.

With f(t) determined, the invention uses Eq. 14b to solve for $\theta(t)$. The value of G* is preferably determined from the value of f(t) just prior to the beginning of the swing, when $\dot{\theta}(t)$ and $\ddot{\theta}(t)$ are assumed to be zero and $\phi_i$ is known. Having previously determined $\phi(t)$ from g(t), one can now reliably subtract G* cos $\phi$ from f(t), yielding $$\xi(t)=l_0(\dot{\theta}^2\cos\beta+\ddot{\theta}\sin\beta) \tag{18}$$

Eq. 18 is used as an update equation to solve for $\theta(t)$. Given $\theta(t)$. $\dot{\theta}(t)$ and $\ddot{\theta}(t)$ one determines $\ddot{\theta}(t+dt)$, $\dot{\theta}(t+dt)$ and $\theta(t+dt)$ as follows:

Define the parameter $\epsilon$ such that, $$\ddot{\theta}(t+dt) = \ddot{\theta}(t) + \varepsilon; \tag{18a}$$

$$\dot{\theta}(t+dt) = \dot{\theta}(t) + \left(\frac{\ddot{\theta}(t+dt) + \ddot{\theta}(t)}{2}\right)dt; \text{ and} \tag{18b}$$

$$\theta(t+dt) = \theta(t) + \left(\frac{\dot{\theta}(t+dt) + \dot{\theta}(t)}{2}\right)dt \tag{18c}$$

To simplify the equations we define the parameters:

$$\dot{\theta}_0 = \dot{\theta}(t) + \ddot{\theta}(t)dt \tag{19a}$$

$$\theta_0 = \theta(t) + \dot{\theta}(t)dt + \ddot{\theta}(t)\frac{dt^2}{2} \tag{19b}$$

Rewriting Eqs. 18(a), 18(b), and 18(c) above, gives $$\dot{\theta}(t+dt) = \dot{\theta}_0 + dt\frac{\varepsilon}{2} \tag{20a}$$

$$\theta(t+dt) = \theta_0 + dt^2\frac{\varepsilon}{4} \tag{20b}$$

Inserting these expressions into Eq. 18 above, one obtains $$\frac{\xi(t+dt)}{l_0} = (\ddot{\theta}_0 + \varepsilon)\sin\left(\beta_0 + \varepsilon\frac{dt^2}{4}\right) + \left(\dot{\theta}_0 + \varepsilon\frac{dt}{2}\right)^2\cos\left(\beta_0 + \varepsilon\frac{dt^2}{4}\right) \tag{21}$$

where we have defined $\beta_0=\theta_0-\phi(t+dt)$. Expanding the above equation to first order in $\epsilon$ yields the preferred expression $$\varepsilon = \frac{\frac{\xi(t+dt)}{l_0} - \ddot{\theta}_0\sin\beta_0 - \dot{\theta}_0^2\cos\beta_0}{\sin\beta_0 + dt\dot{\theta}_0\cos\beta_0 + \frac{dt^2}{4}\left(\ddot{\theta}_0\cos\beta_0 - \dot{\theta}_0^2\sin\beta_0\right)} \tag{22}$$

This value of $\epsilon$ is then used in equations 18(a), 18(b) and 18(c) to determine $\theta(t+dt)$.$\dot{\theta}(t+dt)$, and $\ddot{\theta}(t+dt)$.

In alternate embodiments, Eq. 22 can be solved to higher order in $\epsilon$ if increased numerical precision is deemed necessary.

The above methodology is used to determine $\theta(t)$ and $\phi(t)$ over some range of time. The starting point is the beginning of the swing. The starting parameters, $\phi_i$ and $\theta_i$, are inputs to the calculation. In the preferred embodiment the final points, $\phi_f$ and $\theta_f$, are where the club impacts the ball, though in alternate embodiments one could perform the calculation over any region of time during which one has valid data for $S_1$ and $S_2$.

The values of the final points $\phi_f$ and $\theta_f$ are sensitive to the various independent parameters used in the calculation, $\phi_i$, $\theta_i$, $r_1$, $r_2$, and $l_0$. As is described above, $\phi_i$ and $\theta_i$ can be measured precisely at the start of the swing. The values $r_1$ and $r_2$ are determined as a byproduct of the calculation for f(t). The only remaining independent parameter in this analysis is $l_0$.

The preferred embodiment uses $l_0$ as an adjustable parameter to enforce physically plausible endpoints for $\phi_f$ and $\theta_f$. In the preferred embodiment the condition $\beta_f \approx \beta_i$ is enforced, though one could use any condition, including those determined through video analysis. In practice, the calculation starts by using an estimated value of $l_0$ to calculate $\theta(t)$ and $\phi(t)$. The final points $\phi_f$ and $\theta_f$ are determined and $\beta_f$ is compared to $\beta_i$. Based on this result, $l_0$ is adjusted so as to decrease the difference $|\beta_f-\beta_i|$ and the calculation is performed again. This loop is continued until one obtains the result and performs a loop test that varies $l_0$ until equation 22 gives and update value that leads to a result that gives $\beta_f$ substantially equal to $\beta_i$. In a preferred embodiment the allowable range of $l_0$ relative to the estimated value of $l_0$ is +/−10-20%. If for some reason $l_0$ does not converge to a value that is within the range of +/−10-20%, the swing is repeated.

Display of $\phi(t)$ and $\theta(t)$

Figure 9:
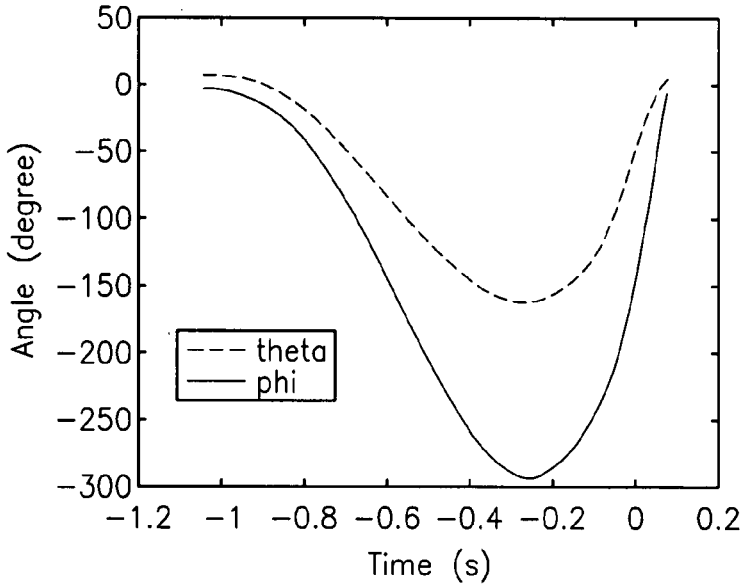
FIG. 9 shows the angular position of the upper and lower portions of the double pendulum as a function of time.

Shown in FIG. 9 are the calculated values of $\phi(t)$ and $\theta(t)$ as a function of time for the conditions $\beta_i=\beta_f=10.5$ degrees. The final value for $l_0$ is 0.48 meters, which is consistent with the estimate of 0.5±0.05 meters used for the analysis for FIG. 9. The maximum speed at impact was calculated to be 84 miles per hour, which is consistent with our separate measurement of 82 miles per hour measure which was checked with a commercial radar speed detector.

Figure 10A:
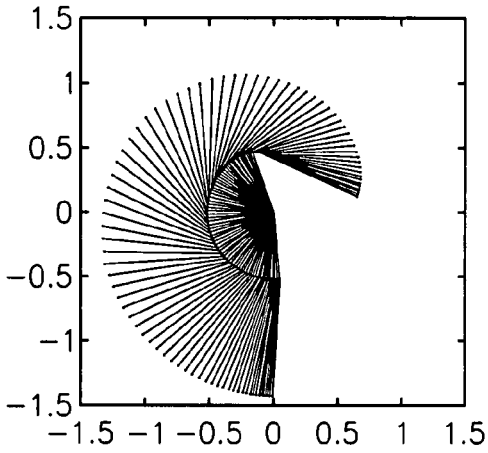
FIG. 10 shows the backswing and down swing positions of the upper and lower portions of a double pendulum representing the player and club during a golf swing.
Figure 10B:
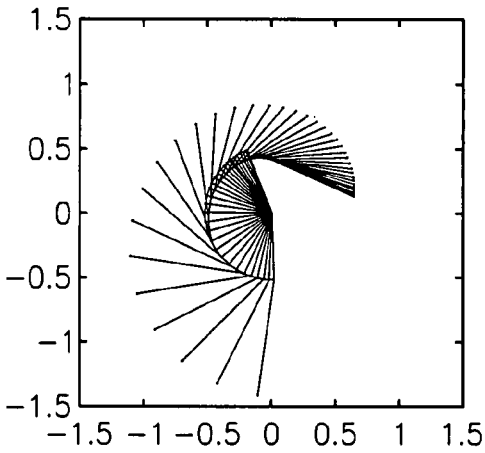

The orientation of the upper and lower portions of the double pendulum in an x-y coordinate system as a function of time is shown in FIG. 10. The axes are calibrated in units of meters.

Figure 11:
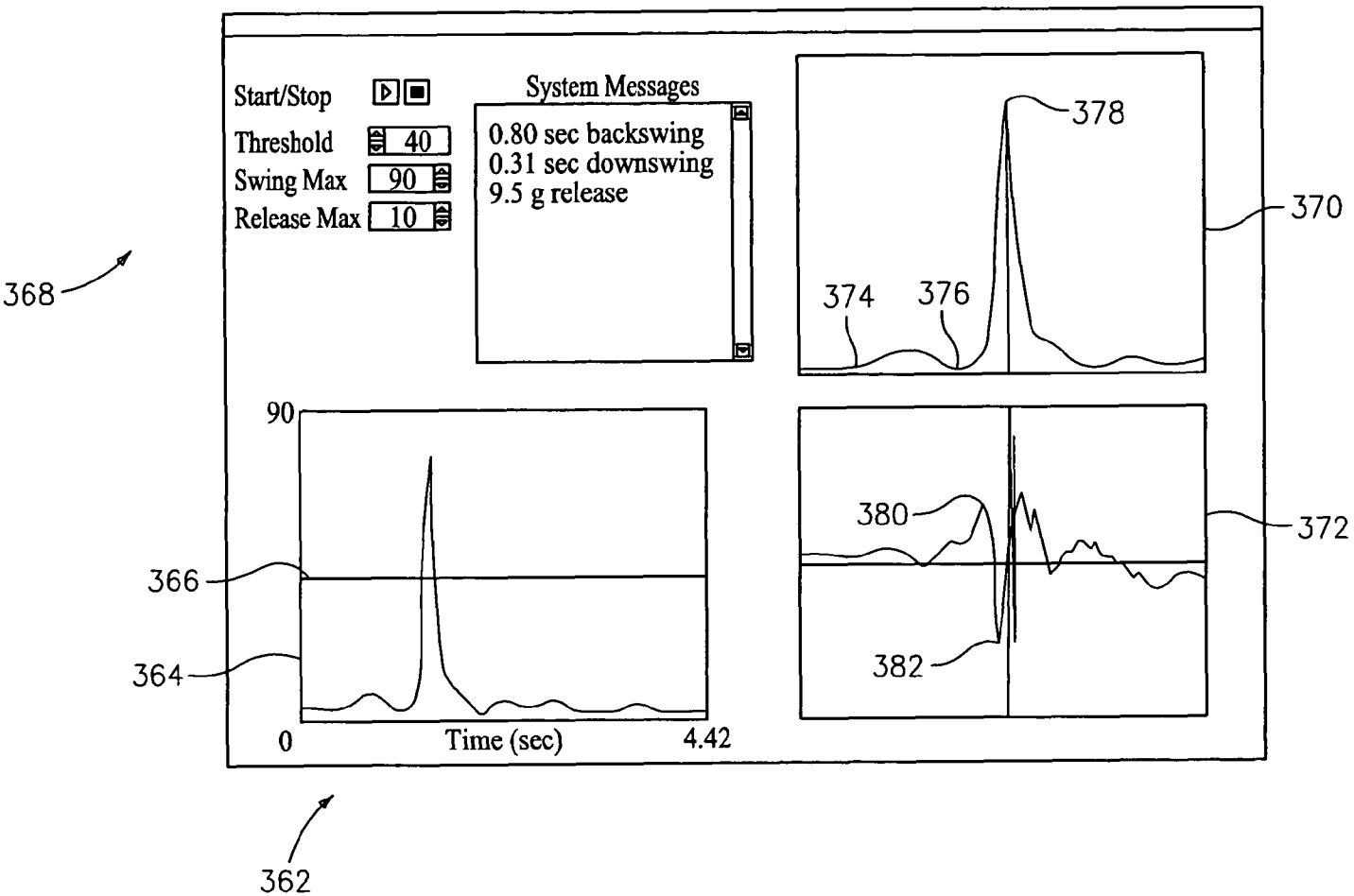
FIG. 11 shows a display of the present invention.

FIG. 11 shows a preferred graphical display area 362 (shown in FIG. 3) for displaying golf swing and invention control parameters. Included in FIG. 11 are raw and reduced data collected and processed by the present invention. Operation of the graphical display area 362 of the present embodiment is preferably programmed in the C# programming language within the Microsoft Visual Studio programming environment.

Display area 362 includes control parameters "Threshold", "Swing Max" and "Release Max" (expressed in g's) which are shown at 368 and used for scaling graphic displays 364, 372, and 370. Also generally shown at 368 is a "System Messages" area which displays certain swing parameters. In the preferred embodiment cursor positions 374, 376 and 378 identify start of backswing, start of downswing and impact respectively, while positions 380 and 382 are used to define the change in common mode acceleration at "release". These cursor positions are determined automatically based on internally set thresholds and time based criteria. In an alternate embodiment cursor position are set manually for alternative analysis protocols.

Graph 364 is labeled "Swing Kinetics", and provides a real-time representation of the difference between the outputs of accelerometers 220 and 225 which is the differential signal, g(t). Graph 370 is labeled "Swing" and also represents g(t) but is presented with an expanded time axis so that acceleration values near ball impact are more clearly visible. Graph 371 is labeled "Release" and represents the common mode signal f(t). Cursor positions 380 and 382 mark the minimum and maximum values f(t) before the impact. Graph 370 and graph 372 are displayed after threshold 366 in graph 364 is exceeded and the graph 364 is completed; that is, a full data set is collected. In an alternate embodiment, display area 362 includes the double pendulum representation of the golf swing modeled in FIGS. 10*a* and 10*b*. The particular set of graphs to be displayed are chosen from a drop down menu not shown in FIG. 11.

In a preferred embodiment the present invention calculates and displays in the message area 368 of FIG. 11 the length of the backswing and the length of the downswing based on time values at cursor positions 376—time at cursor position 374. Also displayed is the g value of release which is the peak to peak intensity of f(t) in the vicinity of the swing just before impact and is the difference of the common mode signal (f(t)) between cursor positions 380 and 382. Likewise maximum differential mode acceleration (g(t)) as well as ball impact are shown at cursor position 378.

The methods of the present invention are not limited to the sport of golf. In fact the methods apply to any analysis of motion of a substantially rigid shaft about a pivot point where accelerometers mounted at positions along the shaft are used to calculate shaft dynamics and the positions of the accelerometers relative to the pivot point are not accurately known.

One skilled in the art would therefore recognize that the methods of the present invention are applicable to an analysis of the dynamics associated with baseball/softball (throwing and batting), tennis, bowling and fishing, among others, which are all readily able to be studied using the methods of the present invention.

Moreover, one skilled in the art would recognize that given the details of motion identified by the methods of the present invention and the physical characteristics of a golf club, bat, or any elongated member, one can also readily find the torque exerted on the club, bat or elongated member.

While the invention has been particularly shown and described with respect to preferred embodiments thereof, it will be understood by those skilled in the art that changes in form and details may be made therein without departing from the scope and spirit of the invention. For example, unless specifically recited in the claims, the order in which the claimed steps are performed is not material to the present invention, and therefore, again, unless explicitly recited, the order set forth in the claims is for convenience purposes only and not in any limiting sense.

What is claimed is:

1. A method for analyzing at least one golf swing parameter using a plurality of accelerometers located proximate distal ends of a golf club, a signal processing and display system utilizing a double pendulum model of a golf club swing, said model for describing swing parameters and having an upper portion, a pivot point and a lower portion, the method comprising the steps of:

entering initial swing conditions and golf club parameters;

performing a swing and collecting data from the accelerometers;

determining a differential mode signal from the acceleration data;

calculating the pivot point location relative to each accelerometer using the accelerometer data;

calculating a common mode signal using the pivot point; and determining at least one golf swing parameter as a function of time using the common mode signal;

wherein at least one of the determining steps or at least one of calculating steps are preformed by at least one of a microprocessor and personal computer.

2. The method as claimed in claim 1, wherein the step of calculating the pivot point location relative to each accelerometer comprises the step of minimizing the contribution of the common mode signal into an accelerometer signal comprising the differential mode signal and the common mode signal.

3. The method as claimed in claim 1, including the step of displaying the at least one golf swing parameter.

4. The method as claimed in claim 3, wherein the step of displaying the at least one golf swing parameter includes displaying the common mode and differential mode signals.

5. The method as claimed in claim 3, wherein the step of displaying golf swing parameters includes displaying positions of the upper and lower portions of the double pendulum model.

6. A method for analyzing at least one golf swing parameter using (i) an instrumented golf club having two accelerometers located at proximate respective distal ends of a golf club, (ii) data collection means and (iii) computer analysis means running a program based on a double pendulum model of a golf club swing, the method comprising the steps of:

entering initial swing conditions and golf club parameters;

performing a swing and collecting data from the accelerometers;

determining a differential mode signal from the acceleration data;

calculating a pivot point location relative to each accelerometer using the accelerometer data;

calculating a common mode signal using the pivot point; and determining at least one golf swing parameter as a function of time using the common mode signal;

wherein at least one of the determining steps or at least one of calculating steps are preformed by at least one of a microprocessor and personal computer.

7. The method as claimed in claim 6, wherein the step of calculating the pivot point location relative to each accelerometer comprises the step of minimizing the contribution of the common mode signal into an accelerometer signal comprising the differential mode signal and the common mode signal.

8. The method as claimed in claim 6, including the step of displaying the at least one golf swing parameter.

9. The method as claimed in claim 8, wherein the step of displaying the at least one golf swing parameter includes displaying the common mode and differential mode signals.

10. The method as claimed in claim 8, wherein the step of displaying golf swing parameters includes displaying positions of the upper and lower portions of the double pendulum model.

11. A method for analyzing at least one motion parameter of an elongated member moving relative to a pivot point using a plurality of accelerometers located at proximate distal ends of the elongated member, a signal processing and display system utilizing a model relating the motion of the pivot point and accelerometers to a reference point, the method comprising the steps of:

entering initial positional and physical parameters of the elongated member;

moving the elongated member about the pivot point and collecting data from the accelerometers;

determining a differential mode signal from the acceleration data;

calculating the pivot point location relative to each accelerometer using the accelerometer data;

calculating a common mode signal using the pivot point location relative to each accelerometer; and determining at least one parameter of motion for the elongated member as a function of time using the common mode signal;

wherein at least one of the determining steps or at least one of calculating steps are preformed by at least one of a microprocessor and personal computer.

12. The method as claimed in claim 11, wherein the step of calculating the pivot point location relative to each accelerometer comprises the step of minimizing the contribution of the common mode signal into an accelerometer signal comprising the differential mode signal and the common mode signal.

13. The method as claimed in claim 11, including the step of displaying the at least parameter of motion for the elongated member.

14. The method as claimed in claim 13, wherein the step of displaying the at least one parameter of motion includes displaying the common mode and differential mode signals.

15. A method for analyzing at least one motion parameter of a swinging elongated member using a plurality of accelerometers located at proximate distal ends of the elongated member, a signal processing and display system utilizing a double pendulum model of the swinging elongated member, said model having an upper portion, a pivot point and a lower portion, the method comprising the steps of:

entering initial positional and physical conditions of the elongated member;

swinging the elongated member and collecting data from the accelerometers;

determining a differential mode signal from the acceleration data;

calculating the pivot point location relative to each accelerometer using the accelerometer data;

calculating a common mode signal using the pivot point location relative to each accelerometer; and determining at least one motion parameter of the elongated member as a function of time using the common mode signal;

wherein at least one of the determining steps or at least one of calculating steps are preformed by at least one of a microprocessor and personal computer.

16. The method as claimed in claim 15, wherein the step of calculating the pivot point location relative to each accelerometer comprises the step of minimizing the contribution of the common mode signal into an accelerometer signal comprising the differential mode signal and the common mode signal.

17. The method as claimed in claim 15, including the step of displaying the at least parameter of motion for the elongated member.

18. The method as claimed in claim 17, wherein the step of displaying the at least one parameter of motion includes displaying the common mode and differential mode signals.

* * * * *